US010816299B2

(12) United States Patent
Fellows et al.

(10) Patent No.: US 10,816,299 B2
(45) Date of Patent: Oct. 27, 2020

(54) TRIGGER-CYCLED FIREARM

(71) Applicant: Franklin Armory Holdings, Inc., Minden, NV (US)

(72) Inventors: Ryan Paul Fellows, Hollister, CA (US); Jay Leonard Jacobson, Minden, NV (US)

(73) Assignee: FRANKLIN ARMORY HOLDINGS, INC., Minden, NV (US)

( * ) Notice: Subject to any disclaimer, the term of this patent is extended or adjusted under 35 U.S.C. 154(b) by 0 days.

(21) Appl. No.: 16/703,763

(22) Filed: Dec. 4, 2019

(65) Prior Publication Data

US 2020/0182574 A1 Jun. 11, 2020

Related U.S. Application Data

(60) Provisional application No. 62/775,940, filed on Dec. 6, 2018.

(51) Int. Cl.

| | |
|---|---|
| ***F41A 19/24*** | (2006.01) |
| ***F41A 19/13*** | (2006.01) |
| ***F41A 19/30*** | (2006.01) |
| ***F41A 19/10*** | (2006.01) |

(52) U.S. Cl.

CPC ..... *F41A 19/24* (2013.01); *F41A 19/10* (2013.01); *F41A 19/13* (2013.01); *F41A 19/30* (2013.01)

(58) Field of Classification Search

CPC ..... F41A 19/10; F41A 19/13; F41A 19/24; F41A 19/25; F41A 19/26; F41A 19/27; F41A 19/30; F41A 19/35; F41A 19/38; F41A 19/40; F41A 19/48; F41A 19/51; F41A 19/53

USPC .... 42/69.01, 69.02, 69.03; 89/128, 152, 153

See application file for complete search history.

(56) References Cited

U.S. PATENT DOCUMENTS

| | | | | |
|---|---|---|---|---|
| 5,651,205 | A | 7/1997 | Ruger et al. | |
| 5,701,698 | A * | 12/1997 | Wesp | F41A 19/35 42/69.02 |
| 6,070,512 | A | 6/2000 | Rohrbaugh | |
| 2010/0236394 | A1 * | 9/2010 | Gomez | F41A 17/42 89/138 |
| 2012/0144712 | A1 | 6/2012 | Rostocil | |
| 2012/0167755 | A1 * | 7/2012 | Rosol | F41A 3/26 89/188 |
| 2015/0308759 | A1 | 10/2015 | Fellows | |

(Continued)

*Primary Examiner* — Bret Hayes

(74) *Attorney, Agent, or Firm* — Bennet K. Langlotz; Langlotz Patent & Trademark Works, LLC

(57) ABSTRACT

Trigger-cycled firearms have a frame, a barrel, a bolt assembly connected to the frame in registration with the barrel and operable to reciprocate between a retracted position and a forward battery position, a trigger lever connected to the frame and operable to move between a forward rest position and a rearward actuated position, and the trigger lever operably connected to the bolt to move the bolt from the forward battery position to the retracted position and to release the bolt to the forward battery position and discharge the firearm in response to movement of the trigger lever from the forward rest position to the rearward actuated position when the bolt is in the forward position. There may be a connector bar pivotally connected to the frame and operably engaged to the bolt assembly and to the trigger lever. The connector bar may be slidably connected to the bolt assembly.

16 Claims, 21 Drawing Sheets

(56) References Cited

U.S. PATENT DOCUMENTS

2017/0299323 A1 10/2017 Nachefski
2019/0011203 A1* 1/2019 Hangen ..... F41A 5/10

* cited by examiner

TRIGGER-CYCLED FIREARM

CROSS-REFERENCE TO RELATED APPLICATION

This application claims the benefit of U.S. Provisional Patent Application No. 62/775,940 filed on Dec. 6, 2018, entitled "Trigger-cycled firearm," which is hereby incorporated by reference in its entirety for all that is taught and disclosed therein.

FIELD OF THE INVENTION

The present invention relates to firearms, and more particularly to a trigger-cycled firearm that utilizes the force from the operator's trigger finger to cycle the action.

BACKGROUND OF THE INVENTION

Semi-automatic firearms are legally defined in many jurisdictions as firearms that utilize a portion of the energy of a firing cartridge to extract the fired cartridge case and chamber the next round, and which require a separate pull of the trigger to fire each cartridge. Many jurisdictions outside of the United States ban the civilian ownership of semi-automatic firearms.

Therefore, a need exists for a new and improved trigger-cycled firearm that provides a firearm having a repeating action that is safe and effective while not being semi-automatic. In this regard, the various embodiments of the present invention substantially fulfill at least some of these needs. In this respect, the trigger-cycled firearm according to the present invention substantially departs from the conventional concepts and designs of the prior art, and in doing so provides an apparatus primarily developed for the purpose of providing a firearm having a repeating action that is safe and effective while not being semi-automatic.

SUMMARY OF THE INVENTION

The present invention provides an improved trigger-cycled firearm, and overcomes the above-mentioned disadvantages and drawbacks of the prior art. As such, the general purpose of the present invention, which will be described subsequently in greater detail, is to provide an improved trigger-cycled firearm that has all the advantages of the prior art mentioned above.

To attain this, the preferred embodiment of the present invention essentially comprises a frame, a barrel, a bolt assembly connected to the frame in registration with the barrel and operable to reciprocate between a retracted position and a forward battery position, a trigger lever connected to the frame and operable to move between a forward rest position and a rearward actuated position, and the trigger lever operably connected to the bolt to move the bolt from the forward battery position to the retracted position and to release the bolt to the forward battery position and discharge the firearm in response to movement of the trigger lever from the forward rest position to the rearward actuated position when the bolt is in the forward position. There may be a connector bar pivotally connected to the frame and operably engaged to the bolt assembly and to the trigger lever. The connector bar may be slidably connected to the bolt assembly. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
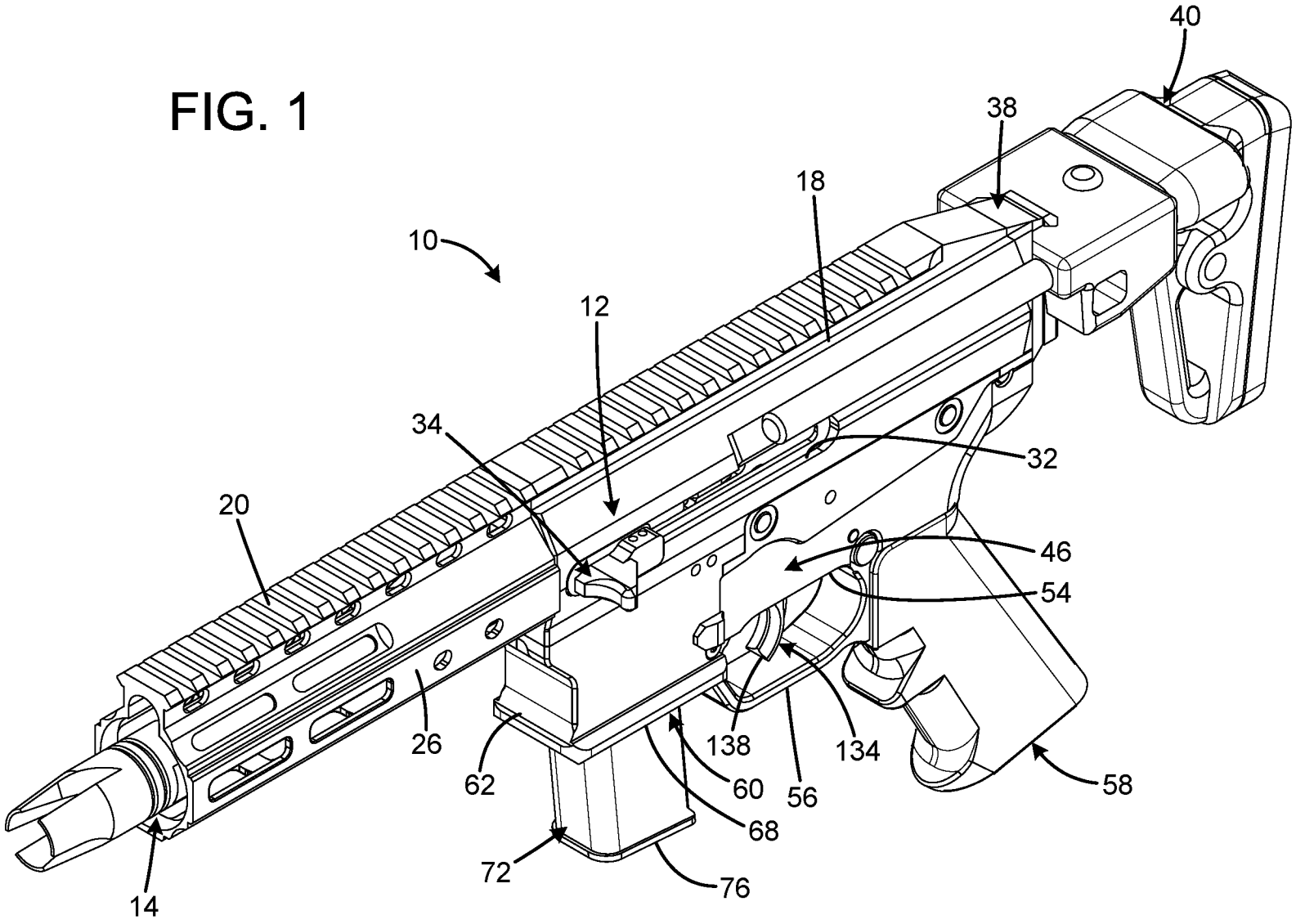
FIG. 1 is a top isometric view of the current embodiment of a trigger-cycled firearm constructed in accordance with the principles of the present invention.

An embodiment of the trigger-cycled firearm of the present invention is shown and generally designated by the reference numeral 10.

Figure 2:
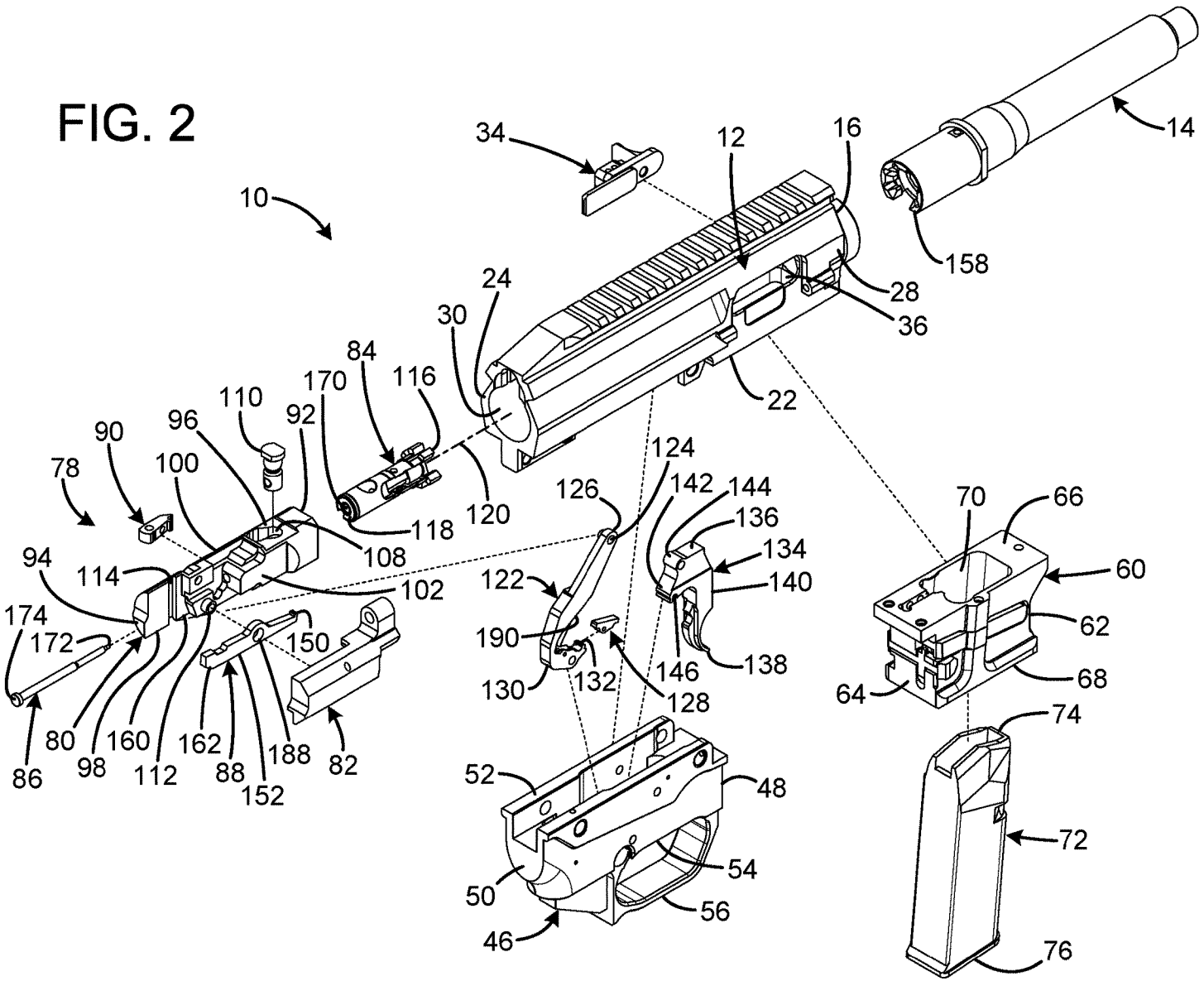
FIG. 2 is an exploded view of the trigger-cycled firearm of FIG. 1 with the rear cap and butt stock omitted.
Figure 3:
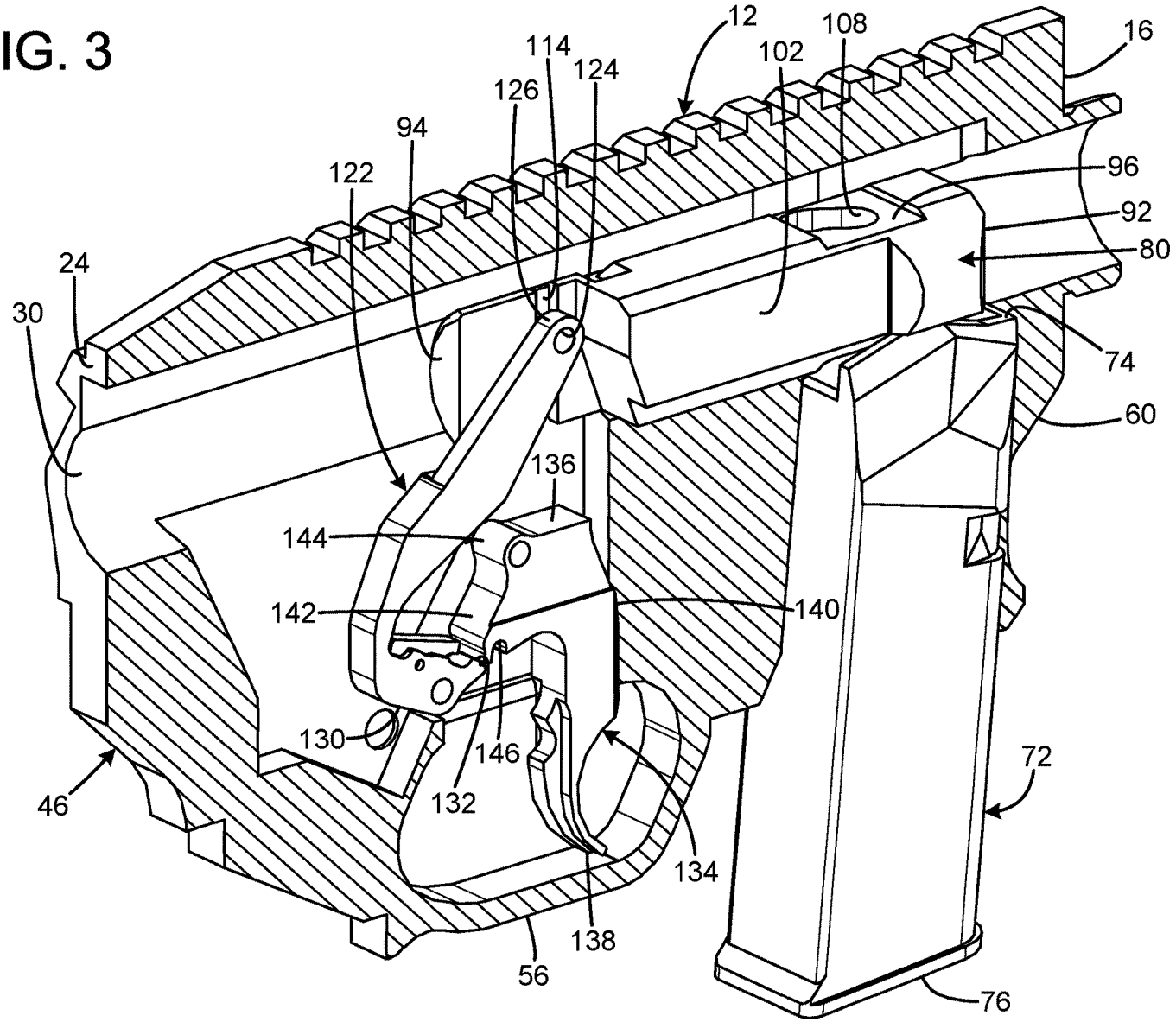
FIG. 3 is a top isometric sectional view of the upper receiver, lower receiver, magazine well assembly, and magazine of the trigger-cycled firearm of FIG. 1.

FIGS. 1-3 illustrate the improved trigger-cycled firearm 10 of the present invention. More particularly, the trigger-cycled firearm includes a frame/upper receiver 12 with a barrel assembly 14 mounted to the front 16 of the upper receiver. The upper receiver has a top 18 that forms an elongated mounting rail 20. The upper receiver also has a bottom 22, rear 24, left side 26, right side 28, and defines a central bore 30. The left side defines a channel 32 that receives a reciprocating charging handle assembly 34. The right side defines an ejection port 36. A rear cap 38 is attached to the rear of the upper receiver. A butt stock 40 is removably attached to a mounting rail 42 (first shown in FIG. 4) formed by the rear 44 of the rear cap.

A lower receiver 46 is attached to the bottom 22 of the upper receiver 12. The lower receiver has a front 48, rear 50, top 52, and bottom 54. The bottom of the lower receiver forms a trigger guard 56. A pistol grip 58 is attached to the bottom rear of the lower receiver.

A magazine well assembly 60 is attached to the bottom 22 of the upper receiver 12 and the front 48 of the lower receiver 46. The magazine well assembly has a front 62, rear 64, top 66, bottom 68, and defines a magazine well 70. A magazine 72 is releasably received within the magazine well. The magazine has a top 74 and a bottom 76. The top of the magazine is in communication with the central bore 30 of the upper receiver 12. The bottom of the magazine protrudes below the bottom of the magazine well assembly.

A bolt assembly 78 is received within the central bore 30 of the upper receiver 12. The bolt assembly includes a bolt carrier 80, bolt carrier side plate 82, bolt 84, fixed firing pin 86, first safety element 88, second safety element 90, and cam pin 110. The bolt carrier has a front 92, rear 94, top 96, bottom 98, left side 100, and right side 102. The front defines a central bore 104 (first shown in FIG. 14). The right side defines a slot 106 (first shown in FIG. 14) that receives the second safety element. A forward portion of the slot is in communication with the central bore. The top defines a cam pin channel 108 that receives the cam pin 110. The right side includes a protrusion 112 that is pivotally received by aperture 188 defined by the first safety element. The right side also defines a vertical channel 114. The bolt carrier side plate is attached to the right side of the bolt carrier. The bolt has a front 116, rear 118, defines a bolt axis 120, and is connected to the cam pin. The rear of the bolt is received by the central bore in the front of the bolt carrier. Rotational movement of the bolt within the central bore in the front of the bolt carrier is controlled by the interaction of the cam pin with the cam pin channel.

A cycle lever 122 is connected to the bolt carrier 80 by a pin (not shown) received in an aperture 124 in the upper end 126 of the cycle lever that is also received by the vertical channel 114. A disconnector 128 is a spring biased movable tab connected to the lower end 130 of the cycle lever. The lower end of the cycle lever also includes a hook feature that serves as a sear 132. The cycle lever has a pivot point 190 located between the upper and lower ends.

A trigger lever 134 has a top 136, bottom 138, front 140, and rear 142. When the trigger lever is installed in the lower receiver 46, the bottom of the trigger lever protrudes from the bottom 54 of the lower receiver and is encircled by the trigger guard 56. The top rear of the trigger lever forms a lobe 144. The rear of the trigger lever below the lobe forms a hook feature 146 that interacts with the disconnector 128 and sear 132 so that a separate pull of the trigger lever is required to fire each cartridge.

Figure 4:
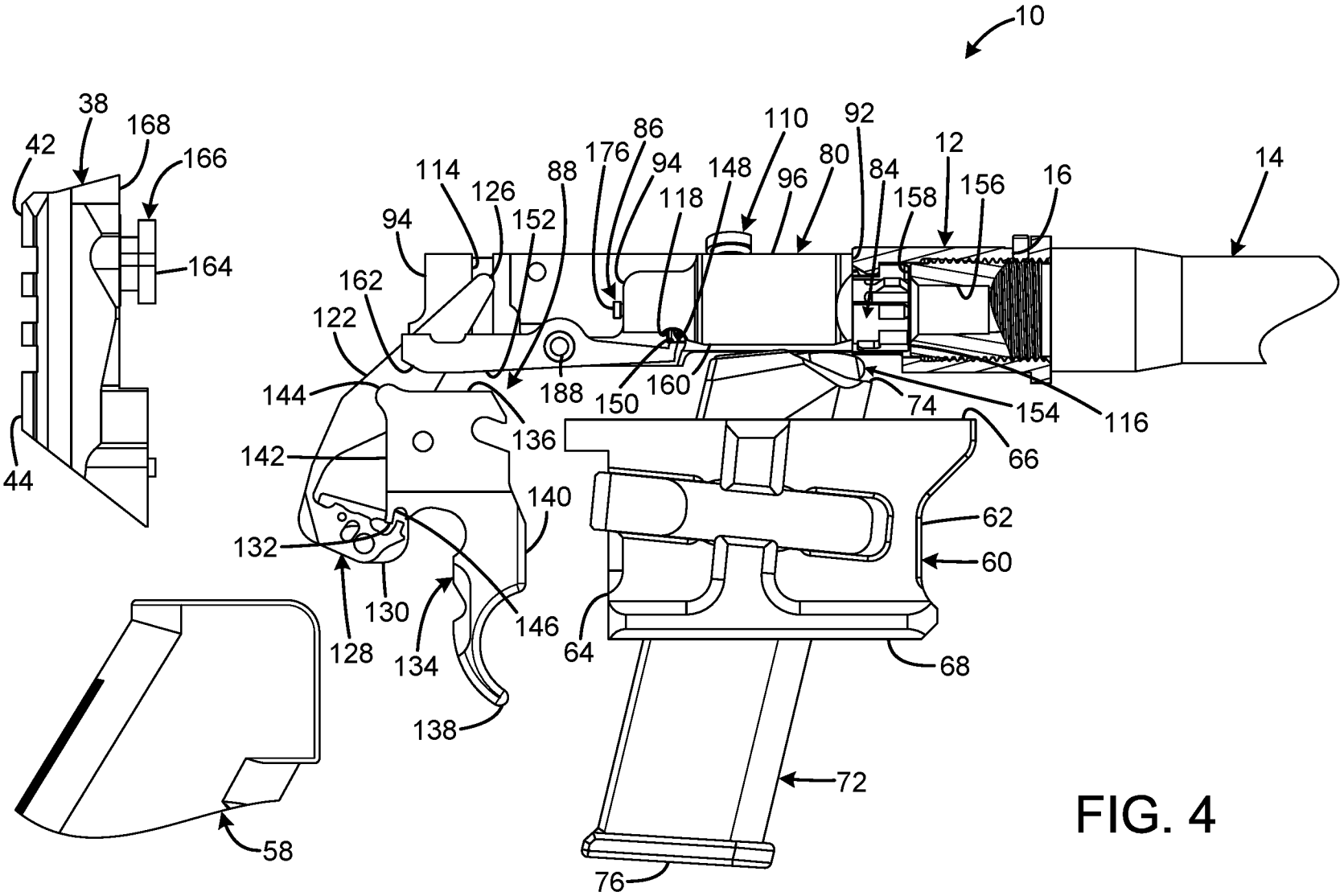
FIG. 4 is a side sectional fragmentary view of the trigger-cycled firearm of FIG. 1 during double action operation immediately after discharge/at rest.
Figure 5:
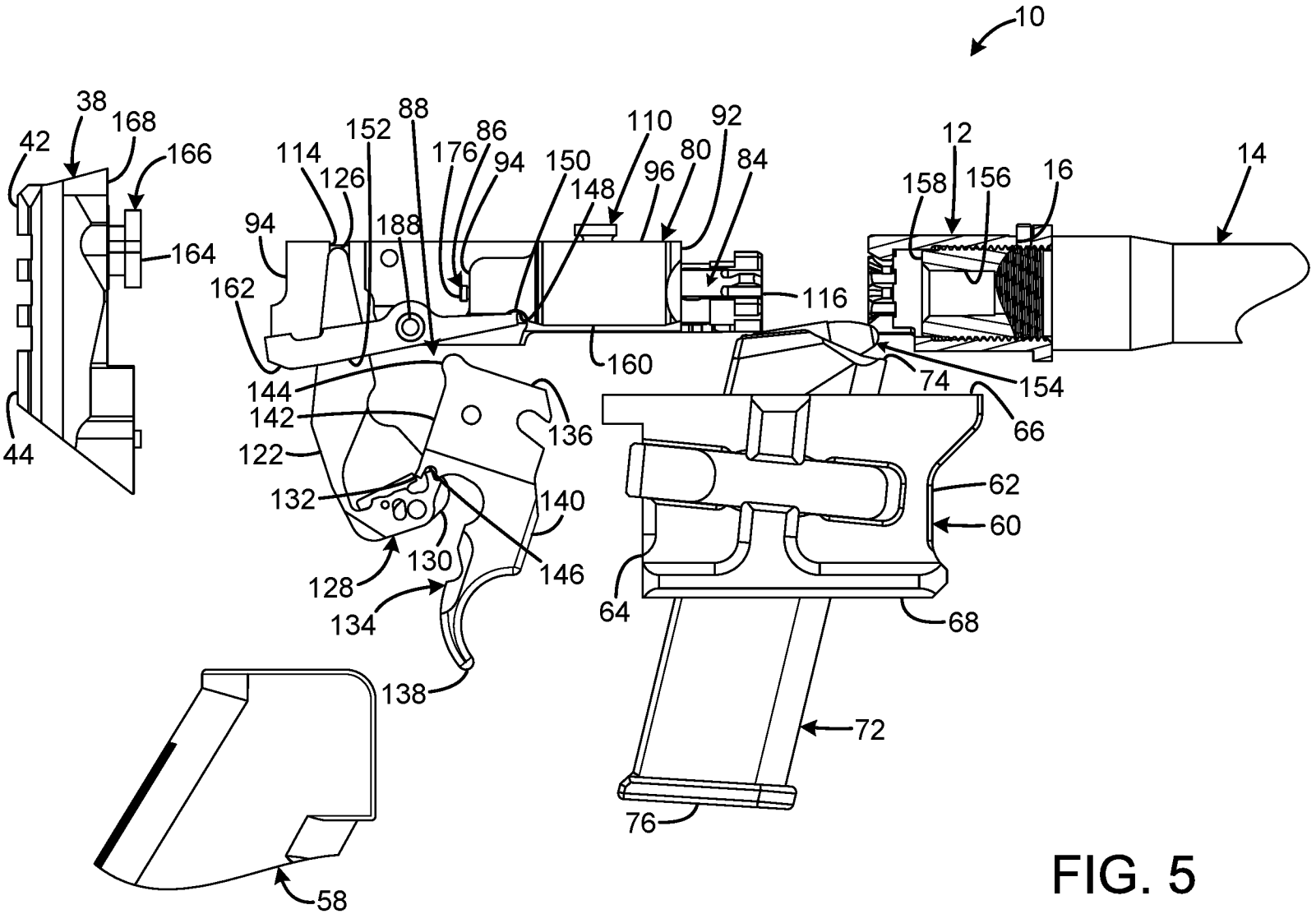
FIG. 5 is a side sectional fragmentary view of the trigger-cycled firearm of FIG. 1 during double action operation at the moment the disconnector hands off the trigger lever to the sear.
Figure 6:
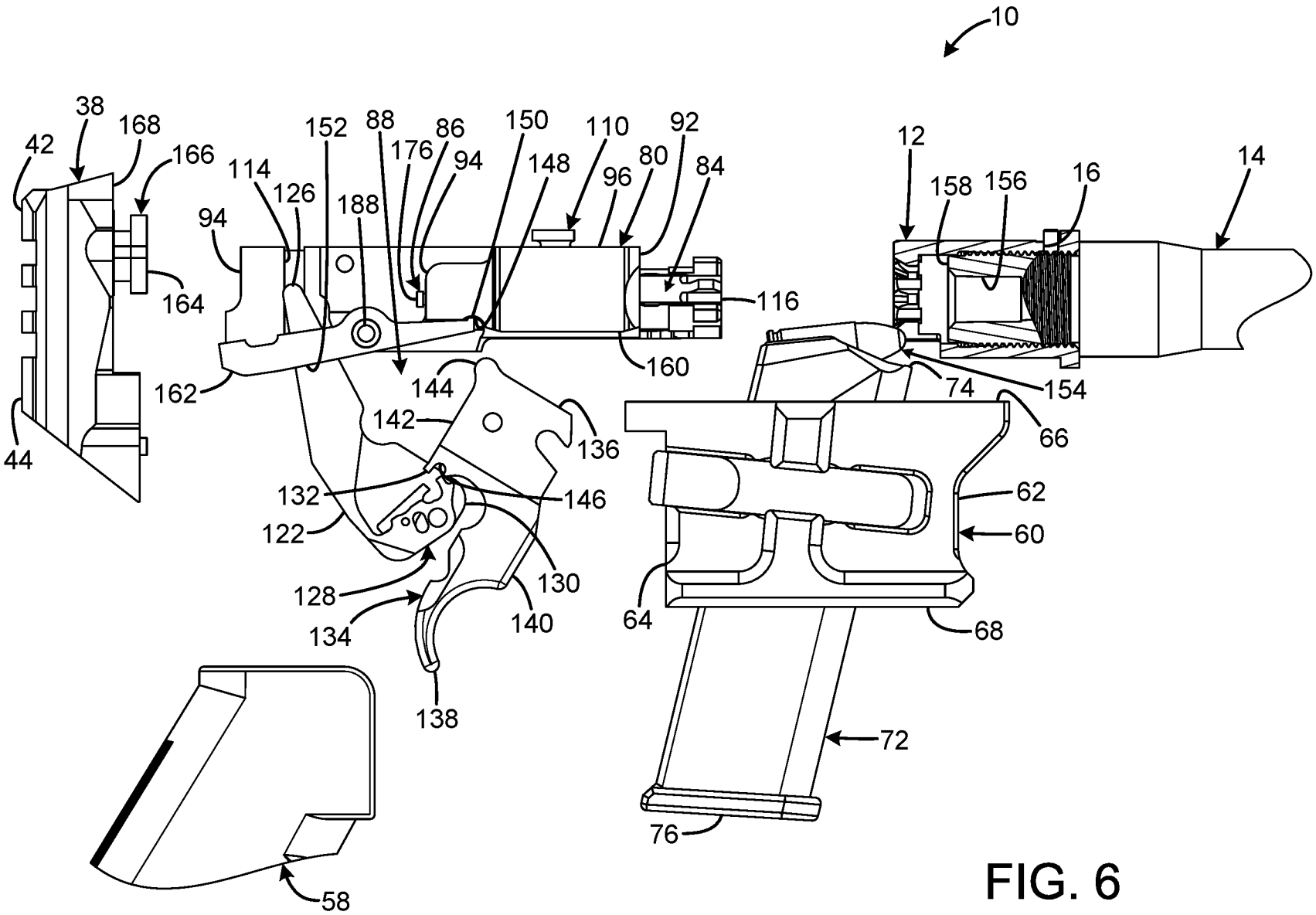
FIG. 6 is a side sectional fragmentary view of the trigger-cycled firearm of FIG. 1 during double action operation at the threshold of firing.
Figure 7:
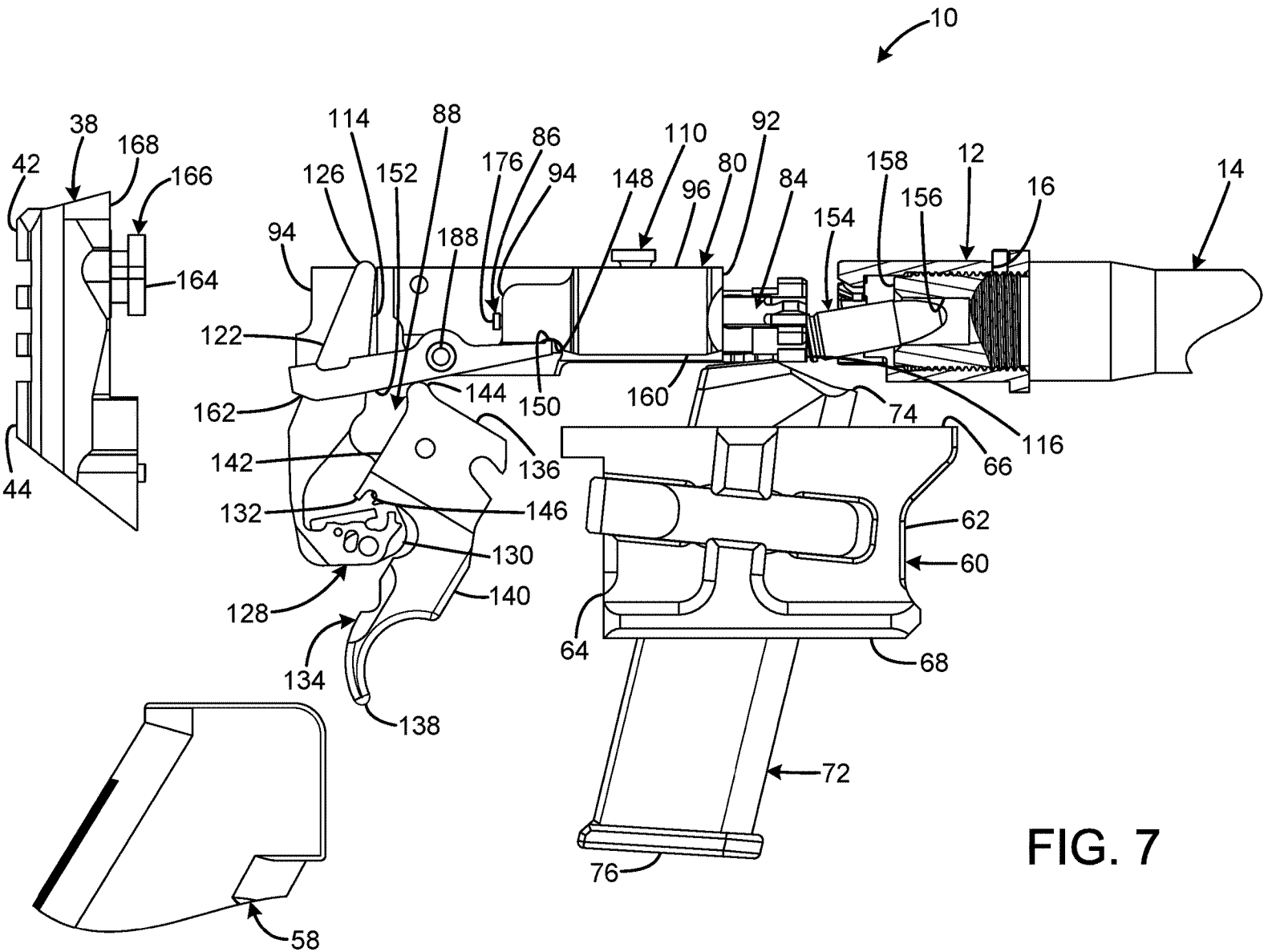
FIG. 7 is a side sectional fragmentary view of the trigger-cycled firearm of FIG. 1 during double action operation as the first safety element encounters the lobe of the trigger lever.
Figure 8:
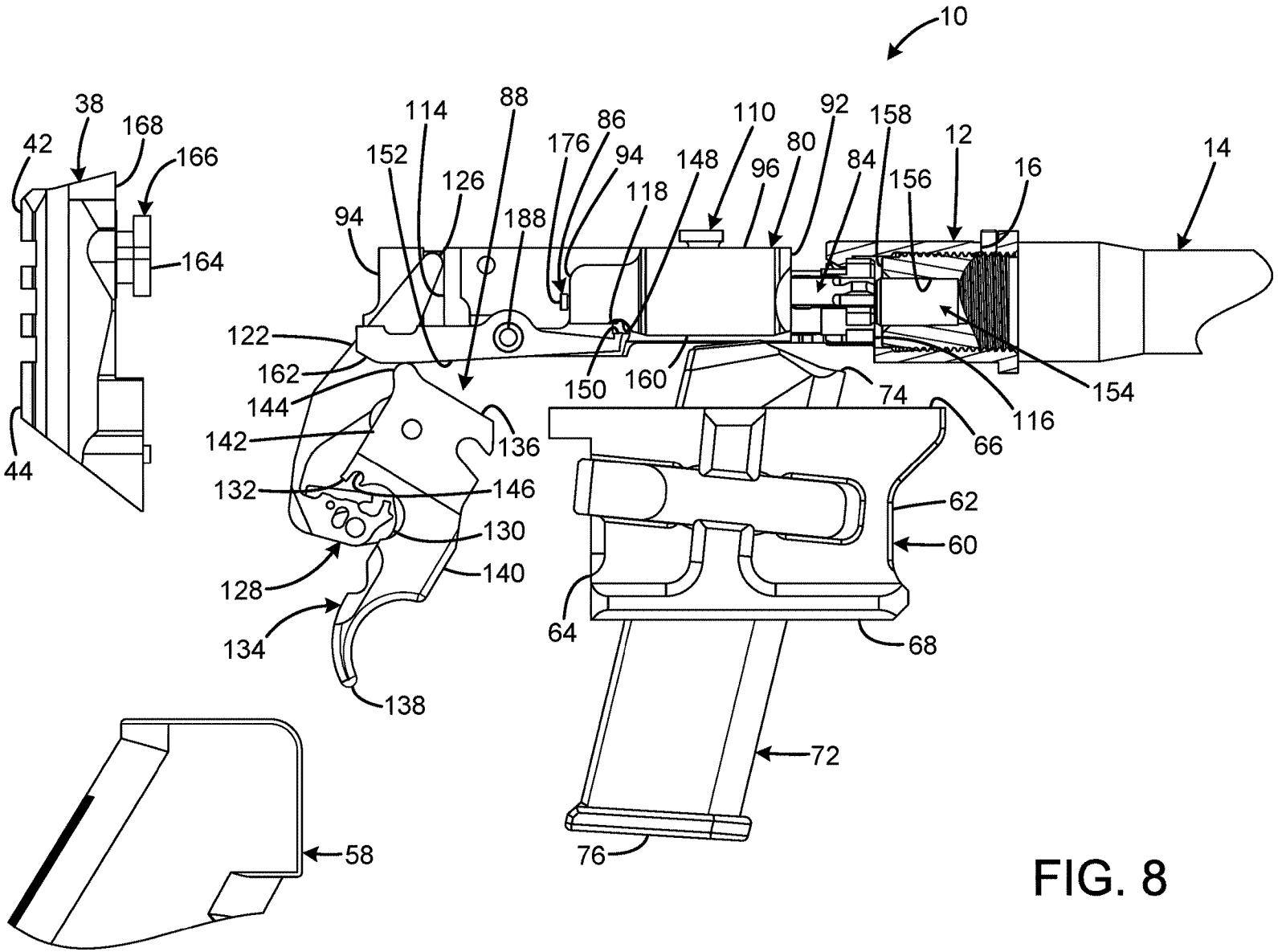
FIG. 8 is a side sectional fragmentary view of the trigger-cycled firearm of FIG. 1 during double action operation as the first safety element is cleared from the bolt gap. The first safety element is in the firing position.
Figure 9:
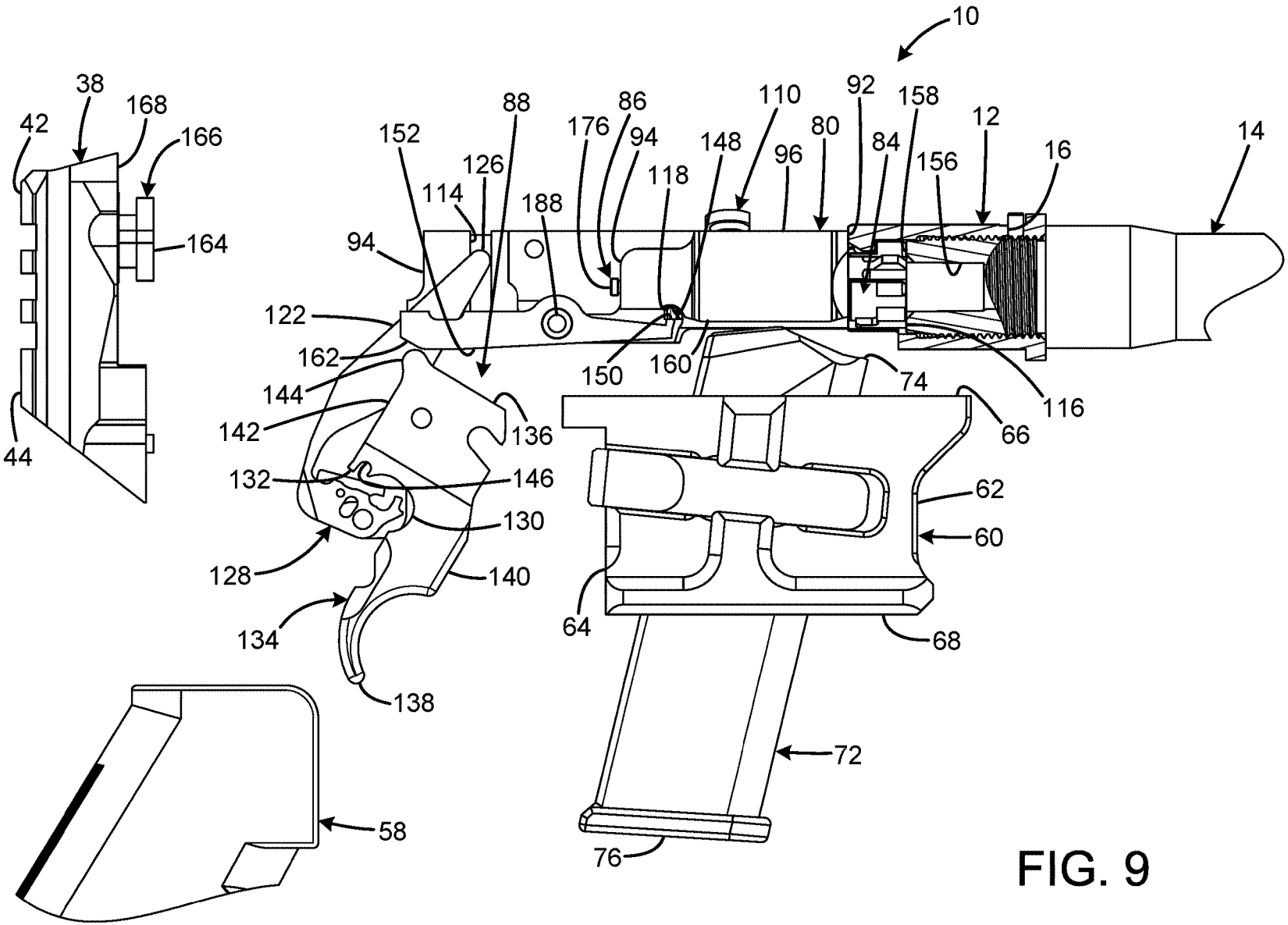
FIG. 9 is a side sectional fragmentary view of the trigger-cycled firearm of FIG. 1 during double action operation with the bolt in the collapsed position/firing condition.

FIGS. 4-9 illustrate the improved trigger-cycled firearm 10 of the present invention. More particularly, the figures illustrate the sequence of operation of the trigger-cycled firearm 10 in double action operation. In FIG. 4, the trigger-cycled firearm 10 is shown immediately after discharge/at rest. The rear 118 of the bolt 84 can be seen within the bolt gap 148 defined by the bottom 160 rear 94 of the bolt carrier 80 because the bolt is in the collapsed position/firing condition within the central bore 104 of the bolt carrier. The rear of the bolt holds the forward toe 150 of the first safety element 88 out of the bolt gap. In the event a spent casing is present in the chamber 156 defined by the rear 158 of the barrel assembly 14, the spent casing is extracted and ejected when the trigger lever 134 is initially pulled. In FIG. 5, the trigger-cycled firearm 10 is shown at the moment the disconnector 128 hands-off the trigger lever 134 to the sear 132. The bolt has moved forward within the central bore 104 of the bolt carrier, and the forward toe of the first safety element has pivoted into the bolt gap under spring pressure (spring not shown). The forward toe prevents the rear of the bolt from occupying the bolt gap to place the bolt in the collapsed position/firing condition. In FIG. 6, the trigger-cycled firearm 10 is shown at the threshold of firing. In FIG. 7, the trigger-cycled firearm 10 is shown as the bottom 152 of the first safety element 88 encounters the lobe 144 of the trigger lever. As the bolt carrier moves forward, the front 116 of the bolt strips the uppermost cartridge 154 from the top 74 of the magazine 72 and loads the cartridge into the chamber. In FIG. 8, the trigger-cycled firearm 10 is shown with the first safety element in the firing position. As the interaction between the lobe of the trigger lever and the bottom of the first safety element has moved rearward, the first safety element has pivoted clockwise sufficiently so that the front toe of the first safety element has cleared the bolt gap. The condition shown in FIG. 8 is the bolt assembly 78 and cycle lever 122 returning to battery under spring bias. The trigger lever has been pulled rearward sufficiently to cause the release of the bolt assembly from being controlled by the trigger lever. This means the trigger lever is also pulled sufficiently to be in a position to deactivate the first safety element because the safety element passes over the trigger lever as the bolt assembly travels. In FIG. 9, the trigger-cycled firearm 10 is shown with the bolt 84 in the collapsed position/firing condition with the rear of the bolt extending into the bolt gap and contacting the front toe of the first safety element to prevent the first toe of the first safety element from reentering the bolt gap. The rearmost portion 162 of the bottom of the first safety element is angled slightly upward so the lobe of the trigger lever will disengage from the bottom of the first safety element. The trigger-cycled firearm 10 returns to the after discharge/at rest condition shown in FIG. 4 under spring pressure (springs not shown) after firing and subsequent release of the trigger lever by the operator. The cycle lever 122 and disconnector 128 are returned to their starting positions after they are released by the trigger lever by the forward movement of the bolt carrier because the cycle lever has its upper end 126 pinned within the vertical channel 114 of the bolt carrier.

Figure 10:
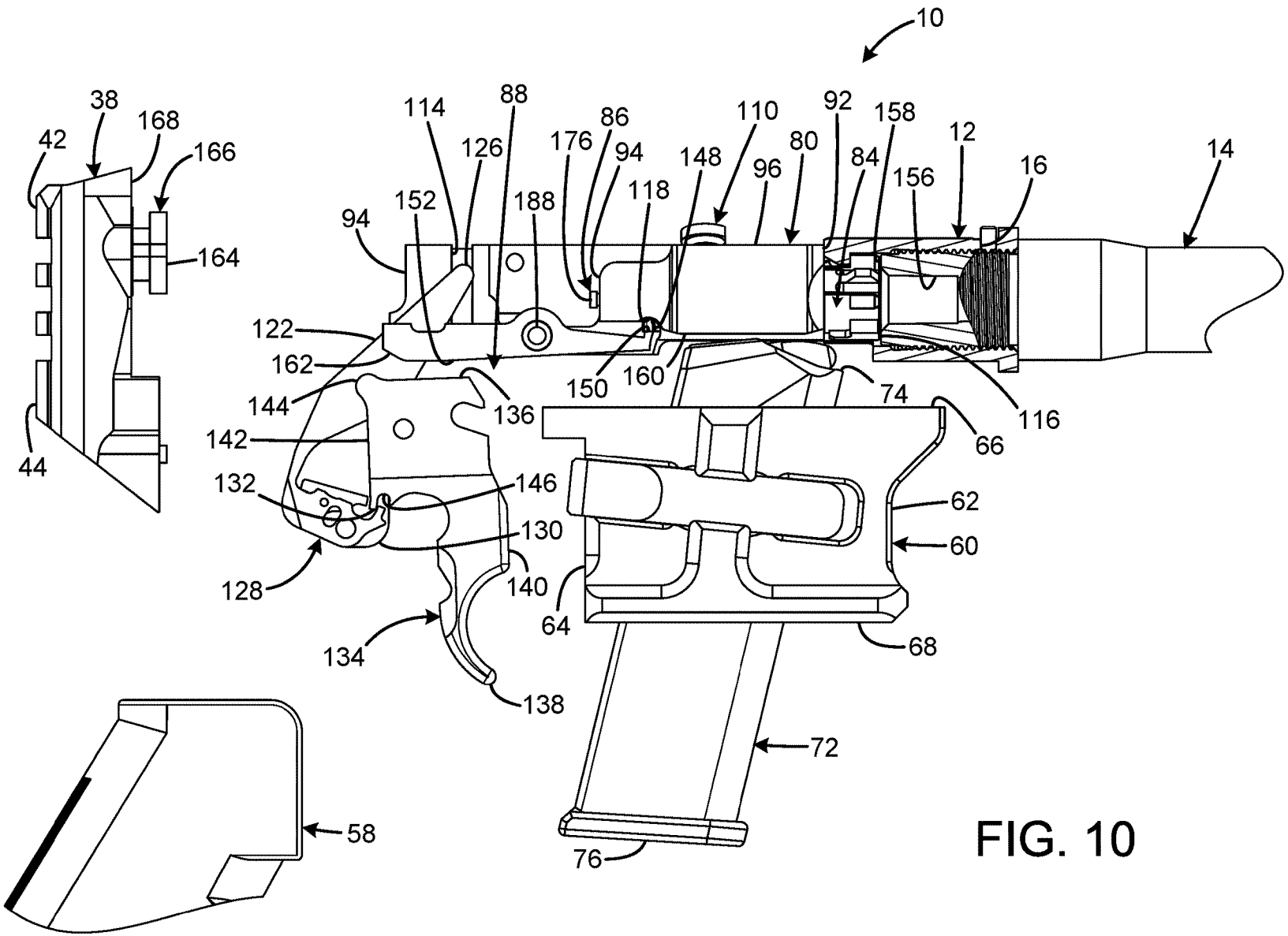
FIG. 10 is a side sectional fragmentary view of the trigger-cycled firearm of FIG. 1 during single action operation immediately after discharge/at rest.
Figure 11:
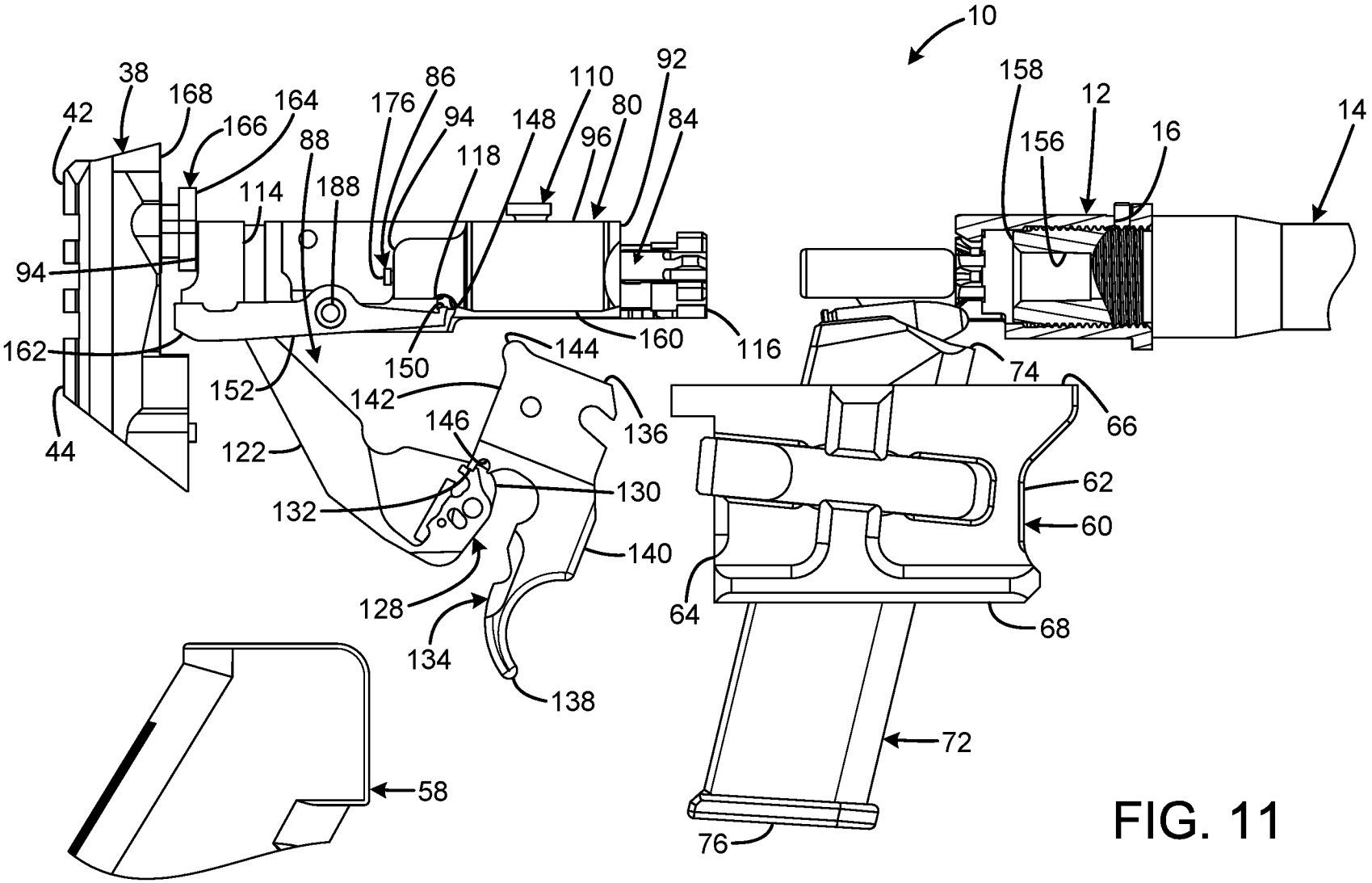
FIG. 11 is a side sectional fragmentary view of the trigger-cycled firearm of FIG. 1 during single action operation at the moment the charging handle assembly is deliberately released.
Figure 12:
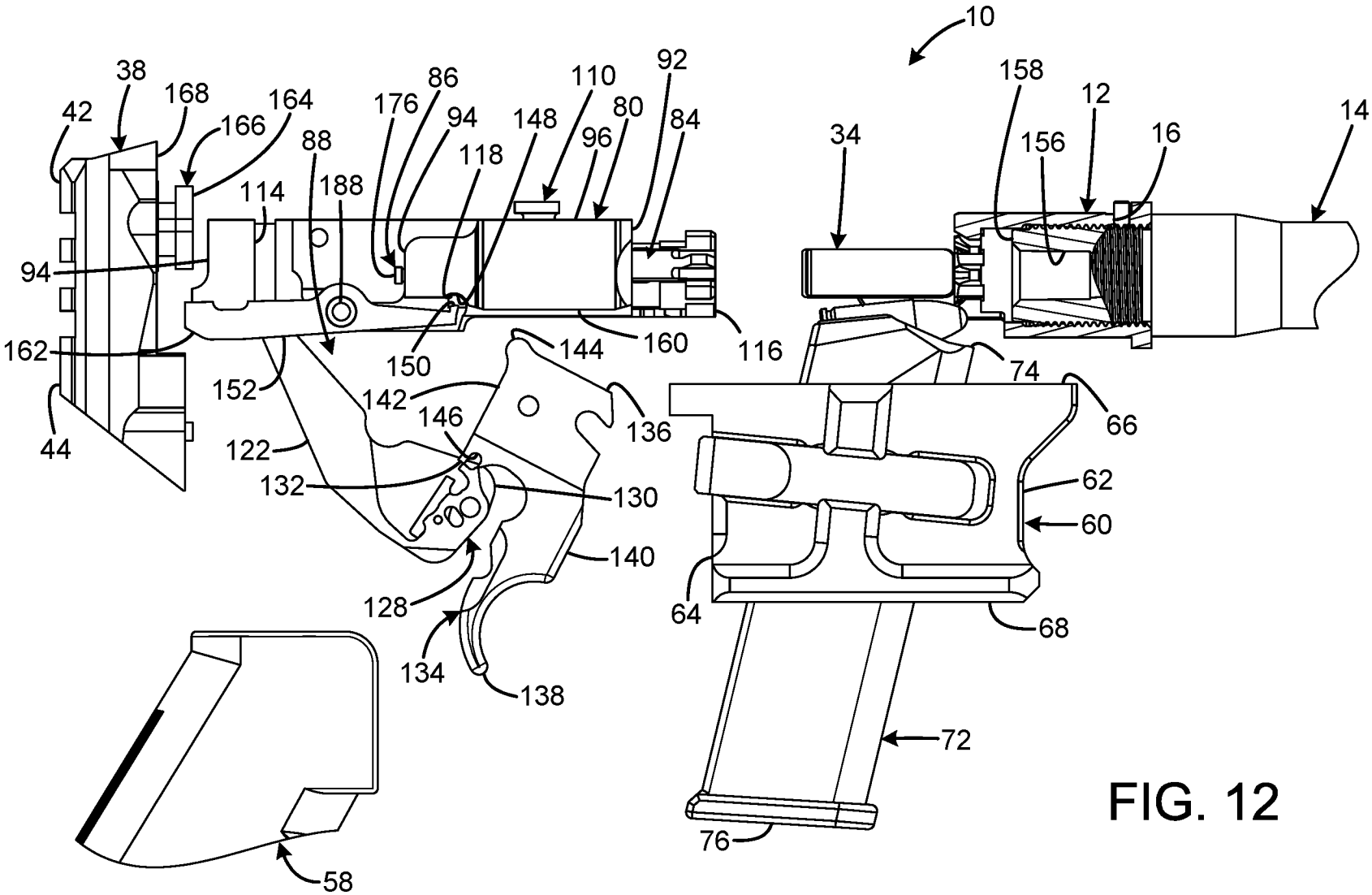
FIG. 12 is a side sectional fragmentary view of the trigger-cycled firearm of FIG. 1 during single action operation at the threshold before the trigger lever is pulled to initiate discharge.
Figure 13:
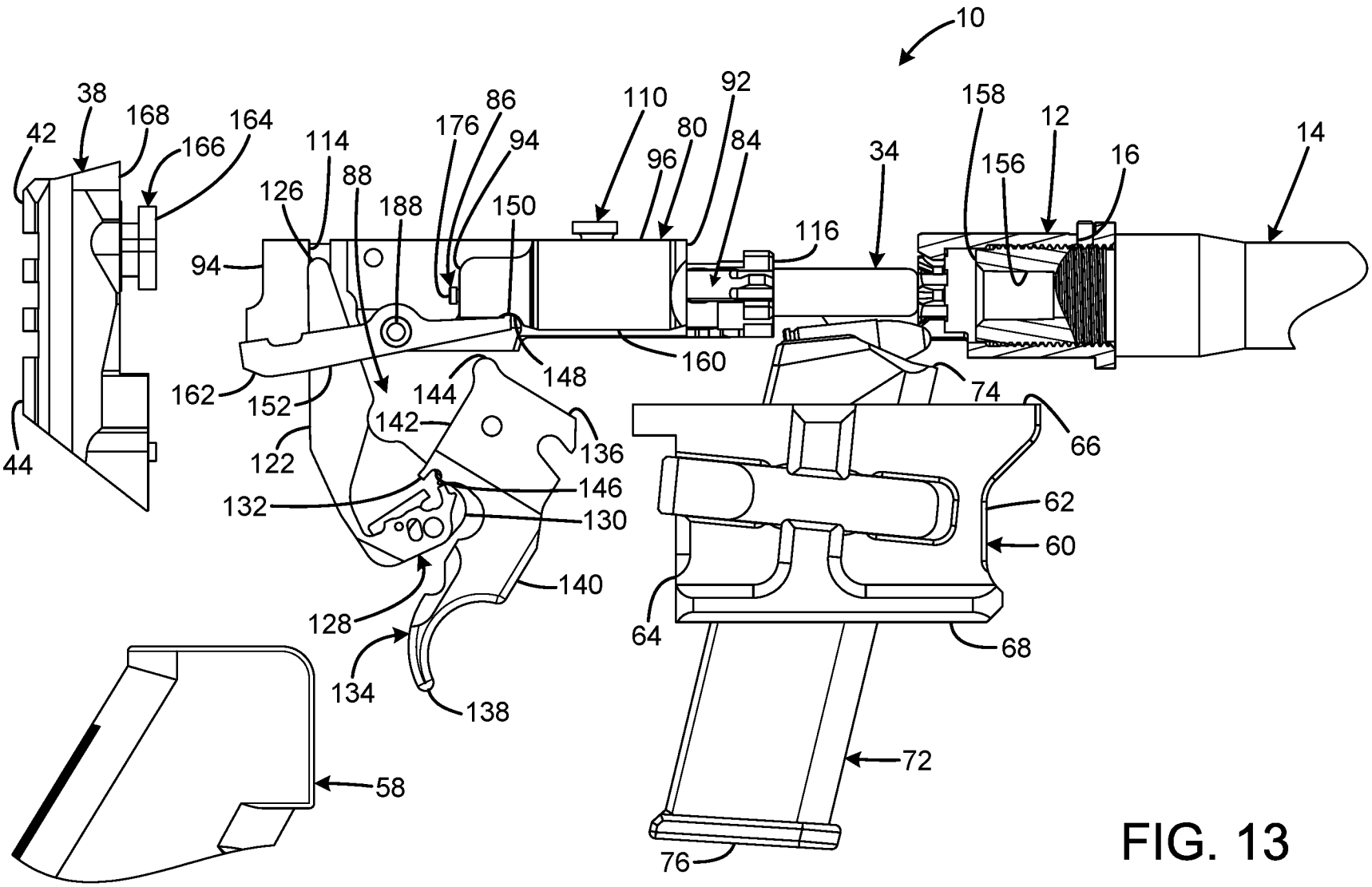
FIG. 13 is a side sectional fragmentary view of the trigger-cycled firearm of FIG. 1 during single action operation at the threshold after the trigger lever is pulled to initiate discharge.

FIGS. 10-13 illustrate the improved trigger-cycled firearm 10 of the present invention. More particularly, the figures illustrate the sequence of operation of the trigger-cycled firearm 10 in single action operation. In FIG. 10, which is identical to FIG. 4, the trigger-cycled firearm 10 is shown immediately after discharge/at rest. The rear 118 of the bolt 84 can be seen within the bolt gap 148 defined by the bottom 160 rear 94 of the bolt carrier 80 because the bolt is in the collapsed position/firing condition within the central bore 104 of the bolt carrier. The rear of the bolt holds the forward toe 150 of the first safety element 88 out of the bolt gap. In the event a spent casing is present in the chamber 156 defined by the rear 158 of the barrel assembly 14, the spent casing is extracted and ejected when the trigger lever 134 is initially pulled. In FIG. 11, the trigger-cycled firearm 10 is shown at the moment the charging handle assembly 34 has been deliberately released after first having been pulled rearwardly until the rear 94 of the bolt carrier 80 has contacted the front 164 of a buffer 166 protruding forwardly from the front 168 of the rear cap 38. In FIG. 12, the trigger-cycled firearm 10 is shown at the threshold before the trigger lever 134 is pulled to initiate discharge. In FIG. 13, the trigger-cycled firearm 10 is shown at the threshold after the trigger lever is pulled to initiate discharge. The hook feature 146 on the trigger lever has disengaged from the sear 132 on the cycle lever 122, which will permit the bolt carrier to fly forward. The remaining steps of the single action operation of the trigger-cycled firearm 10 are identical to those of double action operation shown in FIGS. 7-9, after which the trigger-cycled firearm 10 returns to the immediately after discharge/at rest condition shown in FIGS. 4 and 10. The cycle lever 122 and disconnector 128 are returned to their starting positions after they are released by the trigger lever by the forward movement of the bolt carrier because the cycle lever has its upper end 126 pinned within the vertical channel 114 of the bolt carrier.

Figure 14:
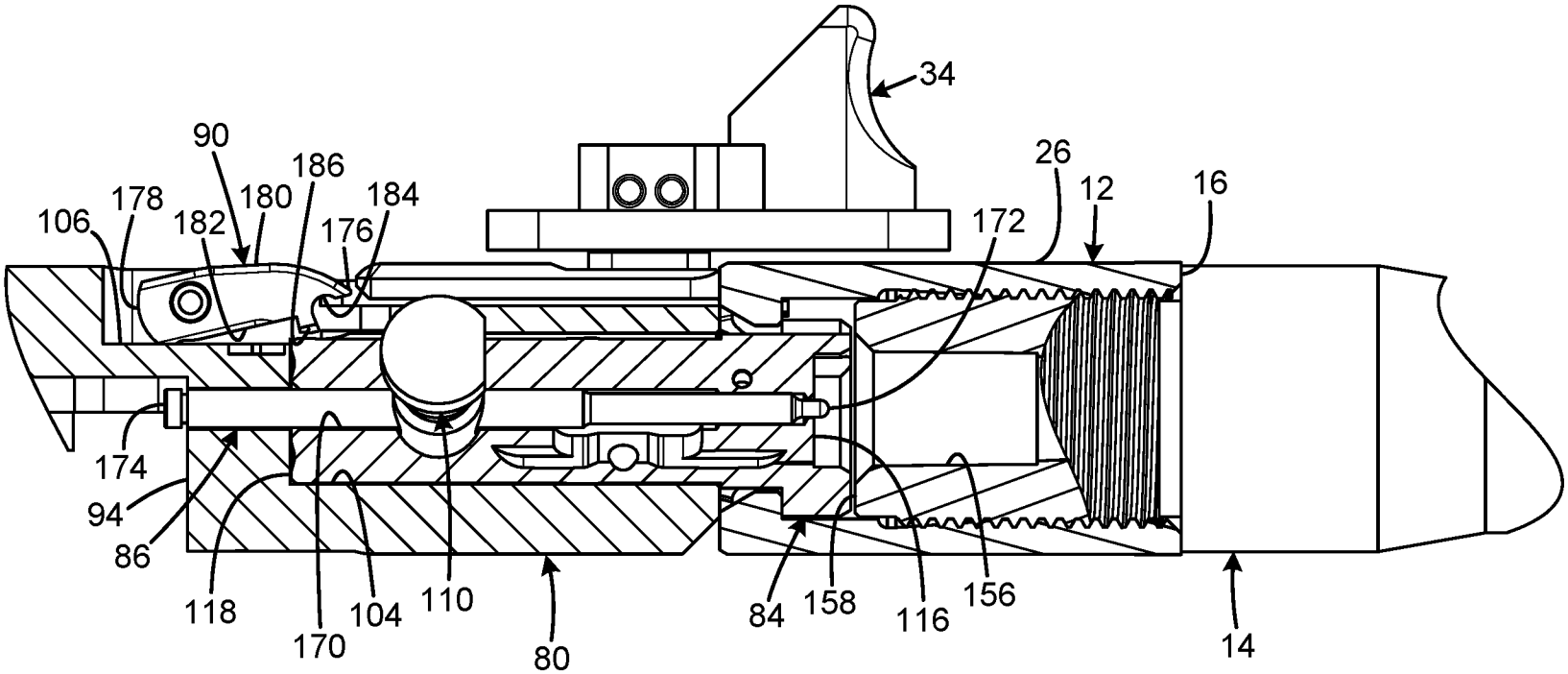
FIG. 14 is a side sectional fragmentary view of the trigger-cycled firearm of FIG. 1 during normal single action operation with the charging handle assembly forward in battery.
Figure 15:
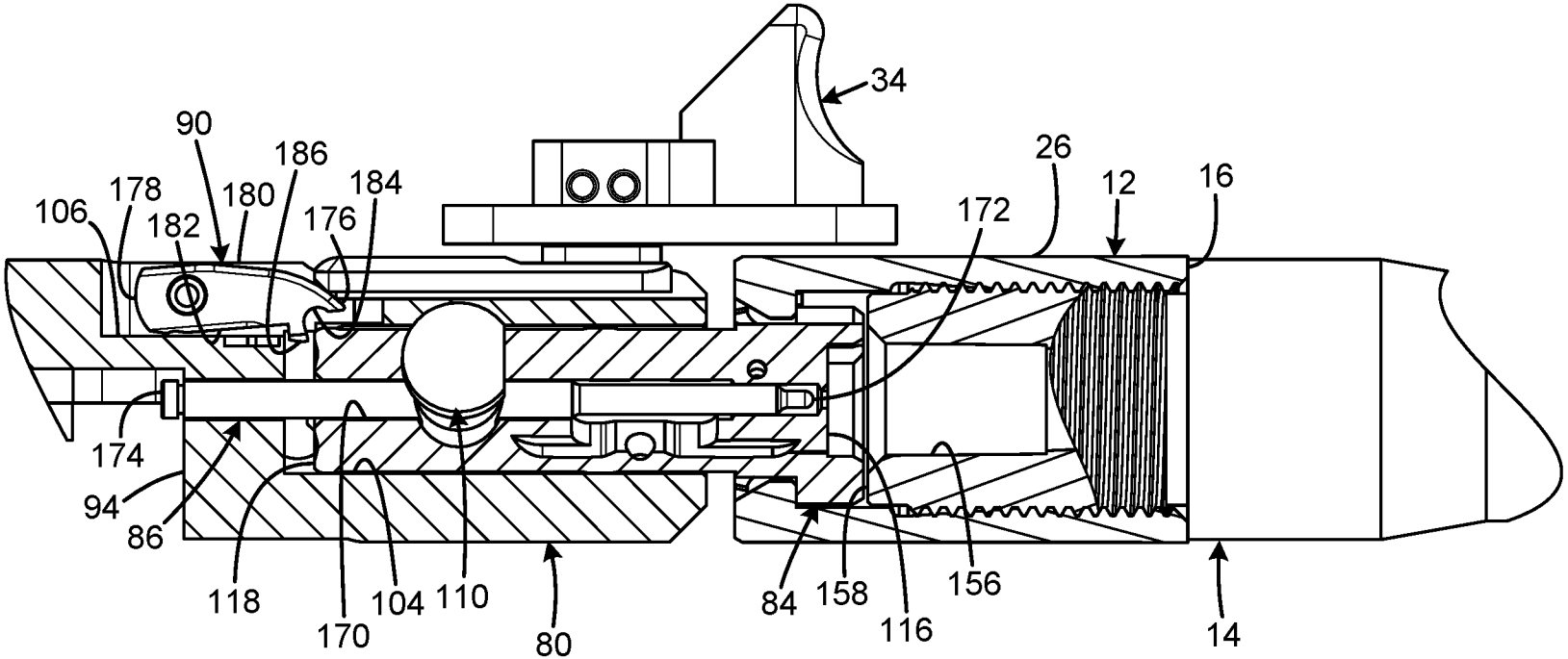
FIG. 15 is a side sectional fragmentary view of the trigger-cycled firearm of FIG. 1 during normal operation in either single or double action operation with the charging handle assembly partially withdrawn and the second safety element intervening behind the rear of the bolt.
Figure 16:
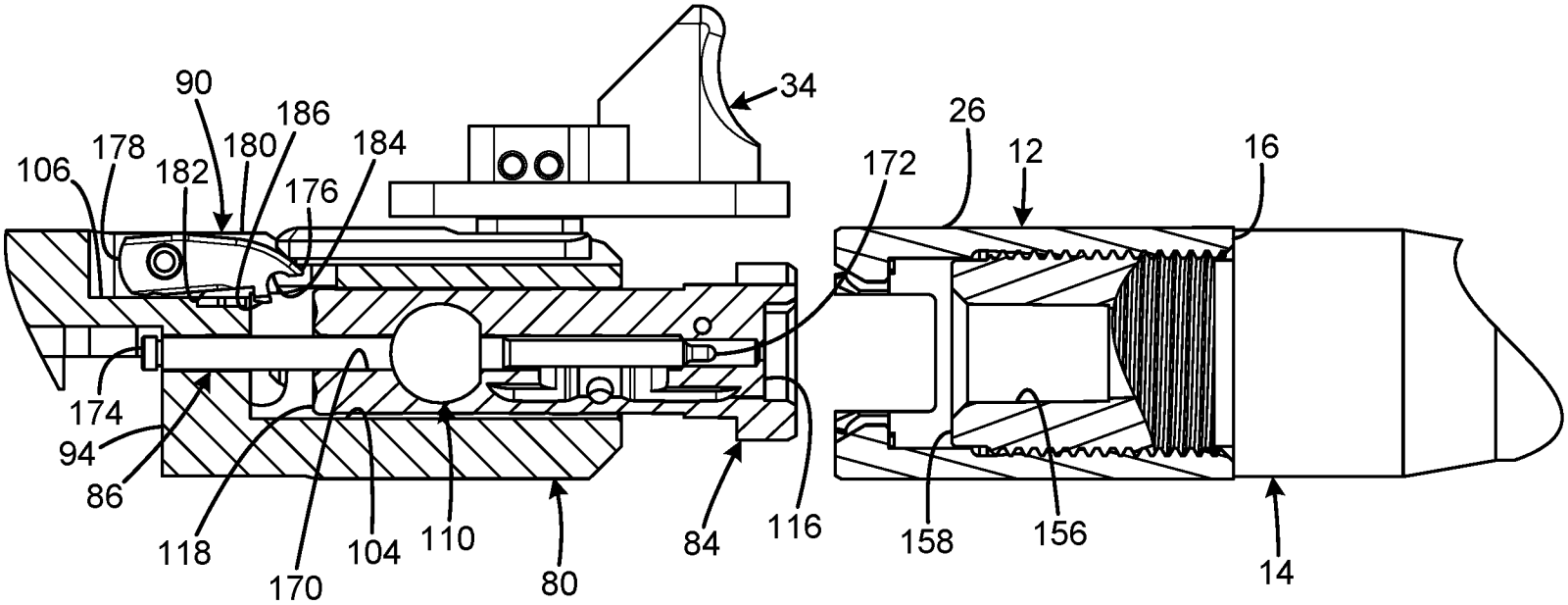
FIG. 16 is a side sectional fragmentary view of the trigger-cycled firearm of FIG. 1 during normal single action operation immediately before the trigger lever has caught the bolt via the cycle lever. The second safety element continues to intervene behind the rear of the bolt.
Figure 17:
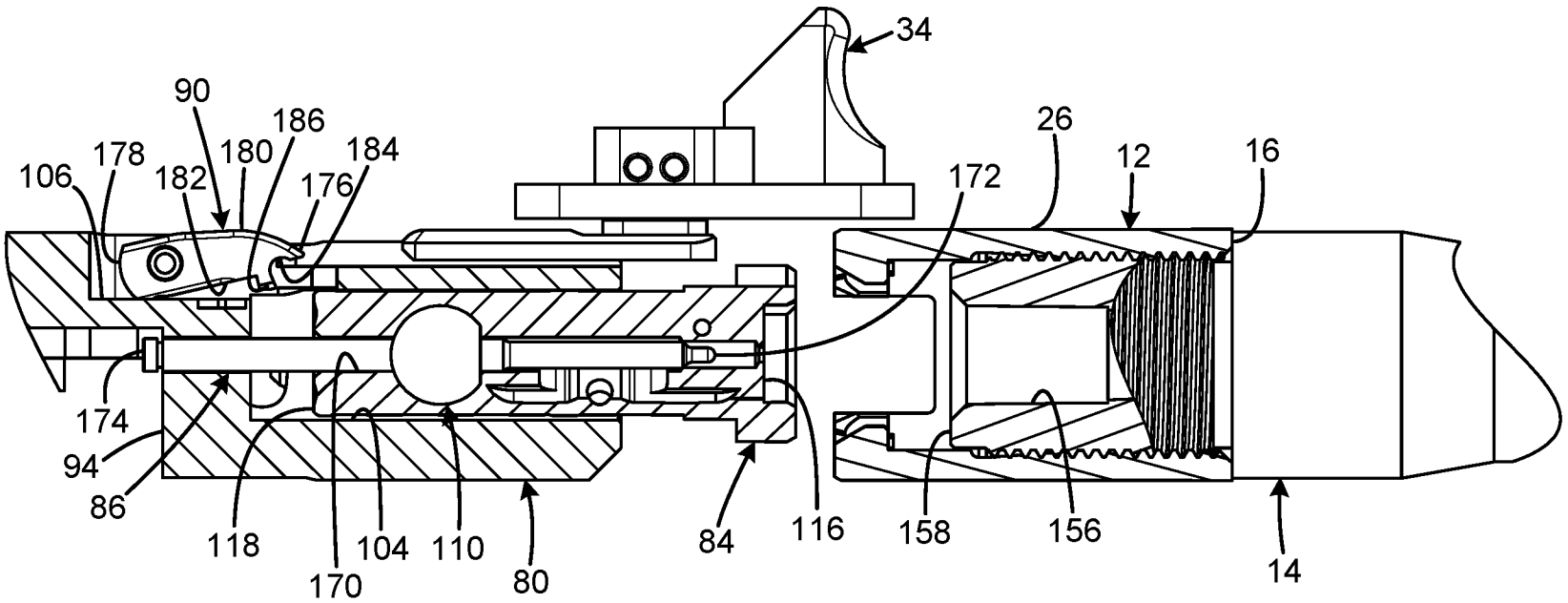
FIG. 17 is a side sectional fragmentary view of the trigger-cycled firearm of FIG. 1 during normal single action operation with the charging handle assembly deliberately released for single action firing. The bolt is caught by the sear's engagement with the trigger lever as the charging handle assembly heads home. The second safety element no longer intervenes behind the rear of the bolt.
Figure 18:
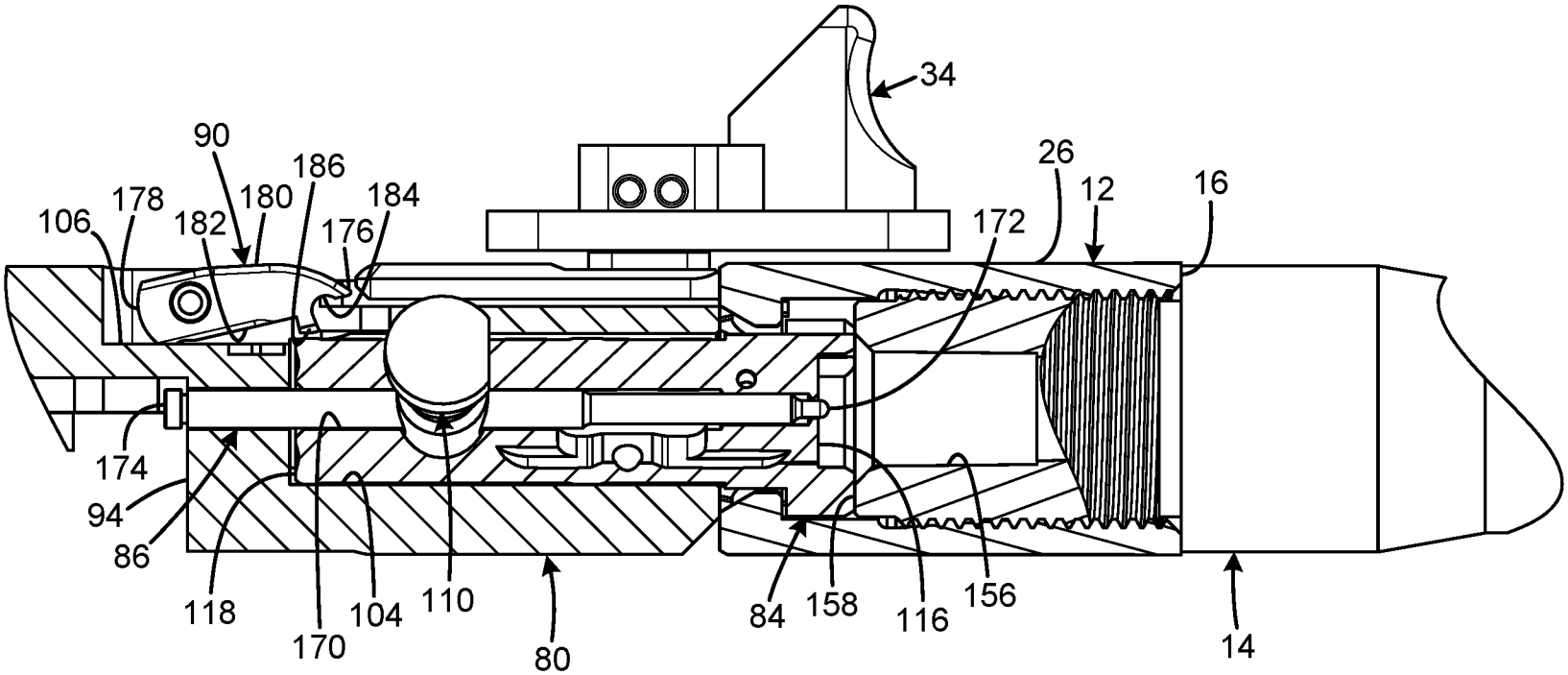
FIG. 18 is a side sectional fragmentary view of the trigger-cycled firearm of FIG. 1 during normal single action operation with the bolt in the collapsed position/firing condition. The fixed firing pin protrudes from the front of the bolt to discharge a cartridge in the chamber.

FIGS. 14-18 illustrate the improved trigger-cycled firearm 10 of the present invention. More particularly, the figures illustrate the sequence of operation of the trigger-cycled firearm 10 in normal single action operation. In FIG. 14, the trigger-cycled firearm 10 is shown with the charging handle assembly 34 forward in battery. The fixed firing pin 86 is received in a central bore 170 defined by the bolt 84. The front 172 of the fixed firing pin protrudes from the front 116 of the bolt when the bolt is in the collapsed position/firing condition. The rear 174 of the fixed firing pin protrudes from the rear 118 of the bolt and from the rear 94 of the bolt carrier. In FIG. 15, the trigger-cycled firearm 10 is shown with the charging handle assembly partially withdrawn and the second safety element 90 intervening behind the rear of the bolt. The second safety element has a front 176, rear 178, top 180, and bottom 182. The top end rear of the second safety element are arcuate in shape. The front defines a substantially circular recess 184 that is bounded on one side by a downwardly protruding tooth 186. When the second safety element intervenes behind the rear of the bolt, the downwardly protruding tooth extends into the central bore 104 defined by the bolt carrier when the charging handle assembly contacts the top of the second safety element and pivots the front of the second safety element clockwise. In FIG. 16, the trigger-cycled firearm 10 is shown immediately before the trigger lever 134 has caught the bolt via the cycle lever 122. The second safety element continues to intervene behind the rear of the bolt. In FIG. 17, the trigger-cycled firearm 10 is shown with the charging handle assembly having been deliberately released for single action firing. The bolt has been caught by the engagement of the sear 132 with the trigger lever as the charging handle assembly heads home. The front of the second safety element has pivoted counterclockwise under spring pressure (spring not shown) so the second safety element no longer intervenes behind the rear of the bolt. In FIG. 18, the trigger-cycled firearm 10 is shown with the bolt in the collapsed position/firing condition. Because the second safety element no longer intervenes behind the rear of the bolt, the rear of the bolt is free to move rearward within the central bore defined by the bolt carrier so the front 172 of the fixed firing pin 86 protrudes from the front of the bolt to discharge a cartridge in the chamber 156.

Figure 19:
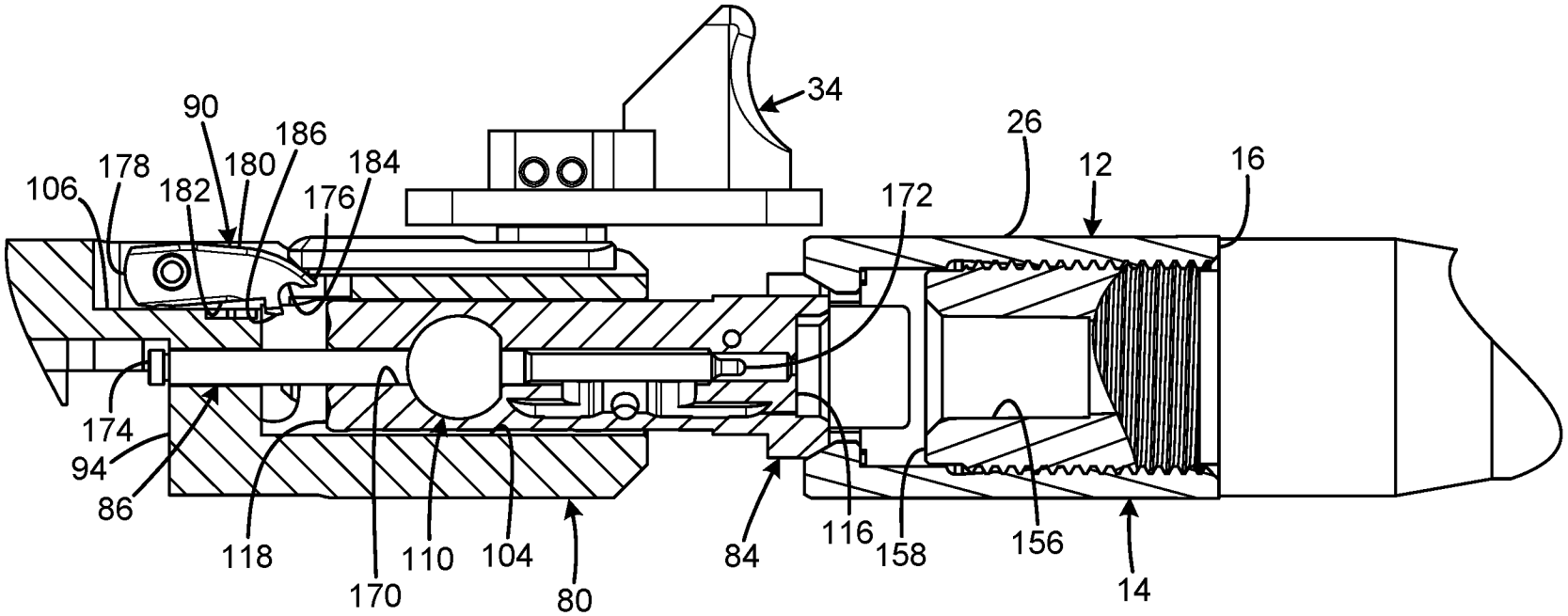
FIG. 19 is a side sectional fragmentary view of the trigger-cycled firearm of FIG. 1 during abnormal single action operation where the charging handle assembly has been inadvertently prematurely released. The second safety element intervenes behind the rear of the bolt.
Figure 20:
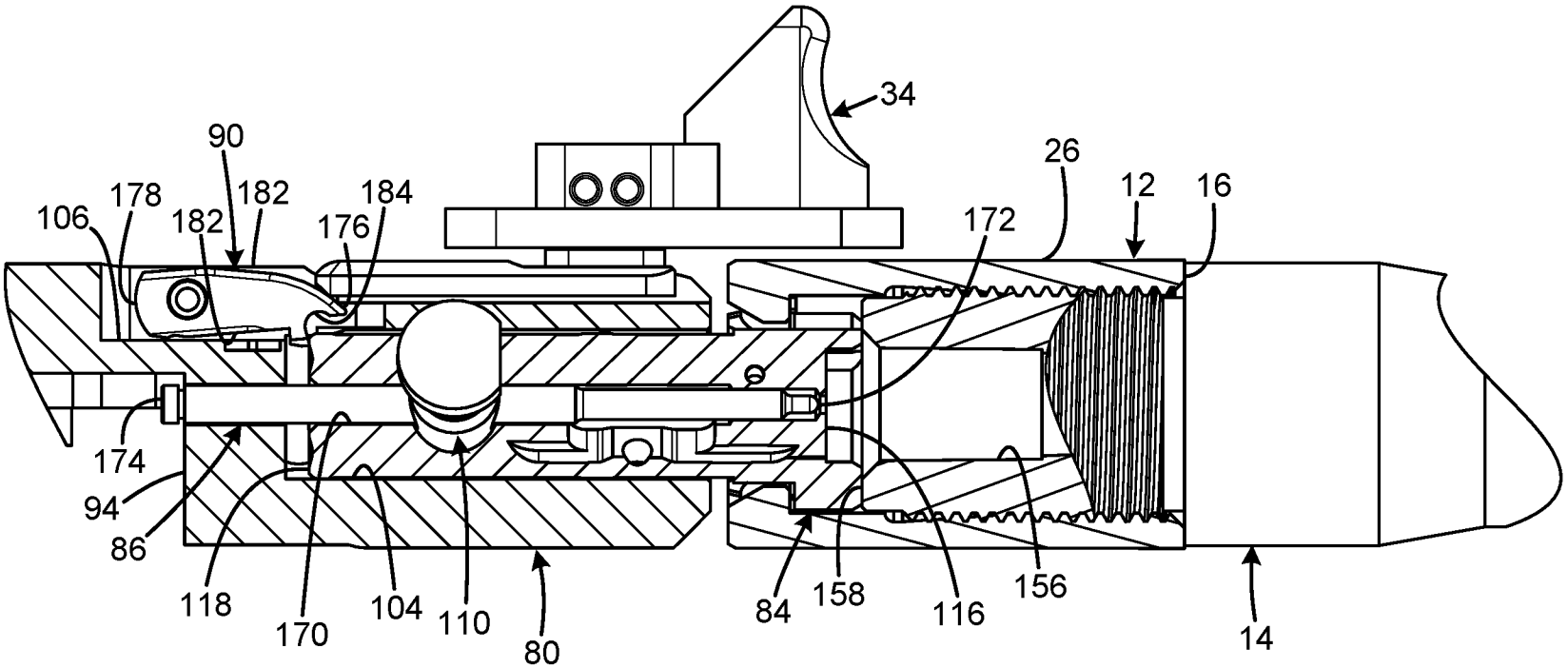
FIG. 20 is a side sectional fragmentary view of the trigger-cycled firearm of FIG. 1 during abnormal single action operation where the charging handle assembly has been inadvertently prematurely released. The second safety element contacts the rear of the bolt.
Figure 21:
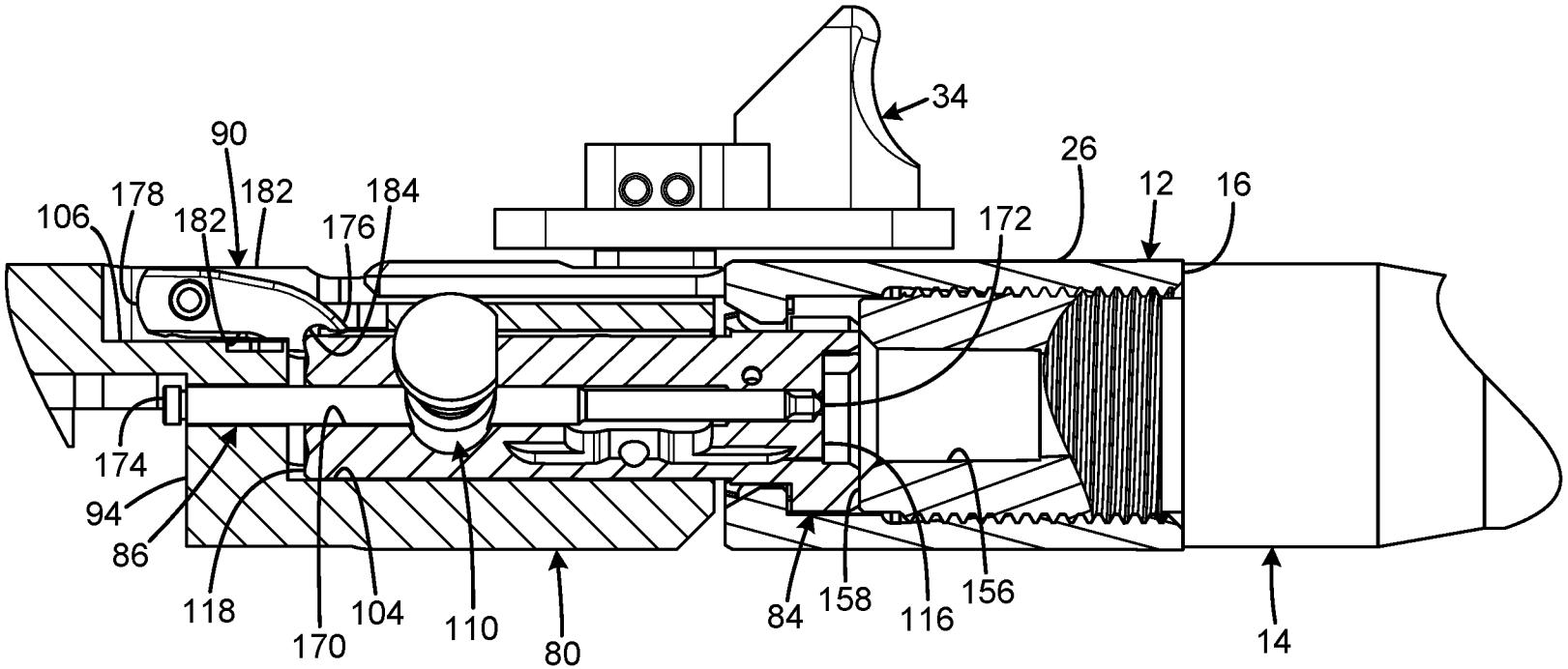
FIG. 21 is a side sectional fragmentary view of the trigger-cycled firearm of FIG. 1 during abnormal single action operation where the charging handle assembly has been inadvertently prematurely released. The second safety element is forced downward and prevents the bolt from reaching the collapsed position/firing condition. This prevents the fixed firing pin from protruding from the front of the bolt to discharge a cartridge in the chamber.

FIGS. 19-21 illustrate the improved trigger-cycled firearm 10 of the present invention. More particularly, the figures illustrate the sequence of operation of the trigger-cycled firearm 10 in abnormal single action operation where the charging handle assembly 34 has been inadvertently prematurely released. In FIG. 19, the trigger-cycled firearm 10 is shown with the second safety element 90 intervening behind the rear 118 of the bolt 84. In FIG. 20, the trigger-cycled firearm 10 is shown with the downwardly protruding tooth 186 of the second safety element contacting the rear of the bolt. In FIG. 21, the trigger-cycled firearm 10 is shown with the front 176 of the second safety element having been forced downward by the rear of the bolt. The downwardly protruding tooth prevents the bolt from continuing to move rearward into the collapsed position/firing condition. This prevents the front 172 of the fixed firing pin 86 from protruding from the front 116 of the bolt to discharge a cartridge in the chamber 156.

It should be appreciated that the action of the trigger-cycled firearm of the current invention utilizes the force from the operator's trigger finger to cycle the action. When starting with a loaded magazine and an empty chamber, the action performs the following functions when operating in double action mode:

1. By pulling the trigger lever, the bolt carrier is forced backward against spring pressure (spring not shown).

2. At a predetermined point in the rearward stroke of the trigger lever, the trigger lever stops acting upon the cycle lever, and the bolt carrier is allowed to freely travel forward under spring pressure.

3. As the bolt carrier travels forward, it feeds a loaded round from the spring-loaded box magazine.

4. As the bolt carrier continues forward, it chambers the loaded round.

5. As the bolt carrier travels further still, the bolt slides into a recess in the barrel extension at the rear of the barrel assembly as the bolt carrier is allowed to continue traveling forward.

6. Under the influence of the cam channel cut into the bolt carrier and upper receiver the bolt is forced to rotate into a locked position as the bolt carrier continues its path forward.

7. At the point the bolt is completely locked, the bolt carrier has approximately 0.020 inch of additional travel before the fixed firing pin is allowed to impact the primer on the loaded cartridge. This is an important buffer zone designed for safety.

8. Once the bolt carrier has traveled fully forward, the fixed firing pin impacts the primer on the chambered cartridge.

9. The loaded round than fires while no parts move, and the bolt remains locked.

10. When the trigger lever is pulled again, the bolt carrier will again travel backwards against spring pressure. While doing so, the bolt carrier will first extract and then eject the spent case through the ejector port.

11. If the trigger lever is pulled further back, the trigger-cycled firearm will repeat the double action cycle beginning with step 2.

The trigger-cycled firearm is not a semi-automatic firearm because it never utilizes any portion of the energy of the firing cartridge to extract, eject, reload a cartridge. Instead, the trigger-cycled firearm utilizes a manually-cycled action. Furthermore, it is believed to have the world's safest action because the trigger-cycled firearm is designed to be stored, carried, and operated with an empty chamber. The only time a round is loaded in the chamber is immediately before it is fired.

When starting with a loaded magazine and an empty chamber, the action performs the following functions when operating in single action mode:

1. By pulling the charging handle assembly, the bolt carrier and the cycle lever are forced backward against spring pressure to a point where the cycle lever is held back by a single action notch located adjacent to the hook feature on the trigger lever. This location is positioned beyond the range of motion of the cycle lever during double action firing. The single action notch can only be utilized when manually activated by the charging handle assembly.

2. By pulling the trigger lever slightly further, the bolt carrier is allowed to freely travel forward under spring pressure.

3. As the bolt carrier travels forward, it feeds a loaded round from the spring-loaded box magazine.

4. As the bolt carrier continues forward, it chambers the loaded round.

5. As the bolt carrier travels further still, the bolt slides into a recess in the barrel extension at the rear of the barrel assembly as the bolt carrier is allowed to continue traveling forward.

6. Under the influence of the cam channel cut into the bolt carrier and upper receiver the bolt is forced to rotate into a locked position as the bolt carrier continues its path forward.

7. At the point the bolt is completely locked, the bolt carrier has approximately 0.020 inch of additional travel before the fixed firing pin is allowed to impact the primer on the loaded cartridge. This is an important buffer zone designed for safety.

8. Once the bolt carrier has traveled fully forward, the fixed firing pin impacts the primer on the chambered cartridge.

9. The loaded round than fires while no parts move, and the bolt remains locked.

10. The single action cycle can be repeated by beginning with step 1.

The first safety element is a trigger-activated bolt carrier lockout. It is designed to prevent an unintentional discharge of the trigger-cycled firearm. This lockout is a physical block to prevent the bolt carrier from going into battery and impacting the fixed firing pin when the trigger lever is not pulled. When the trigger lever is pulled, the lobe is in an upward position that pushes this lockout out of the way. If the bolt carrier has been moved to the rearward by means other than pulling the trigger lever, such as the user pushing it back with a tool, the lobe would be in a downward position when the bolt carrier moved forward to return home. This lockout is spring biased to remain engaged and prevent the bolt carrier from going fully into battery.

The second safety element is a charging handle assembly-activated bolt carrier lockout. It is designed to prevent an unintentional discharge of the trigger-cycled firearm. This lockout is activated when the charging handle assembly is applying rearward force to the bolt carrier. The charging handle assembly causes this lockout to engage, thereby disallowing the bolt carrier from going fully into battery, any time it pushes the bolt carrier past a certain point in the rearward travel range as long as the charging handle assembly remains engaged with the bolt carrier. If the bolt carrier is only charged part way and then released, or if the charging handle assembly follows it back to home, the charging handle assembly stays in contact with the bolt carrier, which keeps this lockout engaged and prevents a full battery lockup. The purpose of this lockout is to prevent someone from charging the bolt carrier almost all the way to single action hookup with the trigger lever, but then mistakenly releasing the bolt carrier. At that point, the trigger-cycled firearm would fire if not for the lockouts. The trigger-activated lockout works in tandem with the charging handle assembly-activated lockout so that even if the charging handle assembly-activated lockout failed, so long as the trigger lever was not being held back at the time of accidental release, the trigger-cycled firearm would still not fire.

When the charging handle assembly-activated bolt carrier lockout is pulled back far enough that the bolt carrier assembly is held by another means, such as the sear in single action mode, and then the charging handle assembly is returned home manually prior to the bolt assembly closing, this lockout is allowed to disengage via its spring bias. Therefore, the bolt carrier is able to achieve full battery when it moves forward and returns home.

It should also be appreciated that the bolt assembly is connected to the frame/upper receiver in registration with the barrel and operable to reciprocate between a retracted position and a forward battery position. The trigger lever is connected to the frame and is operable to move between a forward rest position and a rearward actuated position. The trigger lever is operably connected to the bolt to move the bolt from the forward battery position to the retracted position and to release the bolt to the forward battery position and discharge the firearm in response to movement of the trigger lever from the forward rest position to the rearward actuated position when the bolt is in the forward battery position. The cycle lever is a connector bar pivotally connected to the frame and operably engaged to the bolt assembly and to the trigger lever. The connector bar is slidably connected to the bolt assembly. The bolt assembly defines a bolt axis and defines an interface feature angularly offset from the bolt axis and configured to be engaged by the connector bar. The interface feature is the vertical channel, which is preferably perpendicular to the bolt axis. However, the interface feature can be a channel at an angle relative to vertical to shift the point at which the force from the connector bar is applied perpendicularly to the interface feature surface (either forward or rearward in regard to the bolt travel). It is currently anticipated a suitable range for the angle relative to vertical would be +/−45°. The connector bar includes the disconnector, which is a movable tab configured for selective engagement by the trigger lever. The movable tab is spring biased in a selected direction. The connector bar defines a pivot point and has a first crank length from the pivot point to a first portion (the upper end) contacting the bolt assembly, and a second crank length from the pivot point to a second portion (the lower end) contacting the trigger lever. The first crank length is greater than the second crank length by a magnitude sufficient to demonstrate an appreciable mechanical advantage and is broadly within the range of five to ten times for practical applications. In the current embodiment, the ratio of the first crank length to the second crank length is 7.5:1. However, it should be appreciated that the ratio of the first crank length to the second crank length can vary substantially based upon the desired stroke length of the bolt assembly. The bolt assembly includes the bolt carrier and the bolt, which is movable axially with respect to the bolt carrier between a retracted position and an extended position. The bolt assembly includes a firing element (the fixed firing pin) operable to discharge the firearm when the bolt is in the retracted position, and inoperable to discharge the firearm when the bolt is in the extended position. The bolt is operably engaged to the bolt carrier to rotate based on axial position in the current embodiment. However, alternative bolt locking mechanisms could be employed to lock the bolt to the barrel, including a Fortner-type action. The first and second safety elements are movable between a safe condition in which the first and second safety elements prevent movement of the bolt from the extended position to the retracted position, and a live condition in which movement of the bolt from the extended position to the retracted position is enabled. The charging handle assembly is operably engaged to the bolt assembly and is operable to cycle the bolt assembly. The second safety element is operably engaged to the charging handle assembly.

While a current embodiment of a trigger-cycled firearm has been described in detail, it should be apparent that modifications and variations thereto are possible, all of which fall within the true spirit and scope of the invention. For example, the components such as the barrel, handguard, muzzle device, grip, and butt stock could vary widely from those depicted depending on the application of the trigger-cycled firearm. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a frame;

a barrel;

a bolt assembly connected to the frame in registration with the barrel and operable to reciprocate between a retracted position and a forward battery position;

a trigger lever connected to the frame and operable to move between a forward rest position and a rearward actuated position; and the trigger lever operably connected to the bolt to move the bolt from the forward battery position to the retracted position and to release the bolt to the forward battery position and discharge the firearm in response to movement of the trigger lever from the forward rest position to the rearward actuated position when the bolt is in the forward battery position.

2. The firearm of claim 1 including a connector bar pivotally connected to the frame and operably engaged to the bolt assembly and to the trigger lever.

3. The firearm of claim 2 wherein the connector bar is slidably connected to the bolt assembly.

4. The firearm of claim 3 wherein the bolt assembly defines a bolt axis and defines an interface feature angularly offset from the bolt axis and configured to be engaged by the connector bar.

5. The firearm of claim 4 wherein the interface feature is a channel.

6. The firearm of claim 4 wherein the interface feature is perpendicular to the bolt axis.

7. The firearm of claim 4 wherein the interface feature is vertical.

8. The firearm of claim 2 wherein the connector bar includes a movable tab configured for selective engagement by the trigger lever.

9. The firearm of claim 8 wherein the movable tab is spring biased in a selected direction.

10. The firearm of claim 2 wherein the connector bar defines a pivot point and has a first crank length from the pivot point to a first portion contacting the bolt assembly, and a second crank length from the pivot point to a second portion contacting the trigger lever, and wherein the first crank length is greater than the second crank length.

11. The firearm of claim 10 wherein the first crank length is at least five times the second crank length.

12. The firearm of claim 1 wherein the bolt assembly includes a bolt carrier and a bolt movable axially with respect to the bolt carrier between a retracted position and an extended position, and wherein the bolt assembly includes a firing element operable to discharge the firearm when the bolt is in the retracted position, and inoperable to discharge the firearm when the bolt is in the extended position.

13. The firearm of claim 12 wherein the bolt is operably engaged to the bolt carrier to rotate based on axial position.

14. The firearm of claim 12 including a safety element movable between a safe condition in which the safety element prevents movement of the bolt from the extended position to the retracted position, and a live condition in which movement of the bolt from the extended position to the retracted position is enabled.

15. The firearm of claim 14 wherein the safety element is operably connected to the trigger to remain in the safe condition while the trigger in in the rest position and in intermediate positions between the rest position and the actuated position, and the safety element is in the live condition when the trigger lever is in the actuated position.

16. The firearm of claim 14 including a charging handle operably engaged to the bolt assembly and operable to cycle the bolt assembly, and wherein the safety element is operably engaged to the charging handle.

* * * * *